United States Patent [19]

Marcin

[11] Patent Number: 4,738,381

[45] Date of Patent: Apr. 19, 1988

[54] GARMENT HANGER

[76] Inventor: Bernadine J. Marcin, 3 Kiowa Rd., Salem, N.H. 03079

[21] Appl. No.: 4,127

[22] Filed: Jan. 16, 1987

[51] Int. Cl.[4] ..... A47G 25/20; A47G 25/28

[52] U.S. Cl. ..... 223/88; 223/92

[58] Field of Search ..... 223/88, 91, 92, 93; D6/316, 318, 319

[56] References Cited

U.S. PATENT DOCUMENTS

| | | | |
|---|---|---|---|
| D. 230,118 | 1/1974 | Geisler | D6/319 |
| 711,477 | 10/1902 | Crawford | 223/92 |
| 1,132,530 | 3/1915 | Warren | 223/92 X |
| 1,910,901 | 5/1933 | Koplow | 223/92 |
| 2,372,458 | 3/1945 | Tewell | 223/88 |
| 2,419,621 | 4/1947 | Harris et al. | 223/92 |
| 2,448,726 | 9/1948 | Nelson | 223/88 |
| 2,528,036 | 10/1950 | Cook | 223/92 |
| 2,637,471 | 5/1953 | Goldschmidt et al. | D6/316 X |
| 3,008,615 | 11/1961 | Bury et al. | 223/93 |

FOREIGN PATENT DOCUMENTS

| | | | |
|---|---|---|---|
| 1077806 | 5/1954 | France | 223/92 |
| 1203461 | 7/1959 | France | 223/88 |
| 1529154 | 5/1968 | France | 223/92 |

*Primary Examiner*—Robert R. Mackey

[57] ABSTRACT

A single garment hanger which intends to position, hug, lift, and give superior support to a variety of articles of clothing, i.e.: oversized, furs, delicate knits, fragile nightwear, shoulder-padded, and off the shoulder clothing by virtue of its combined features. It is: oversized for furs and the larger more contemporary tops of the current fashions, possesses egg-shaped areas for off-the-shoulder garments, the same egg-shapes are elevated and contoured to match the shapes of shoulder padded outfits, styled with a dip before each egg-shaped area to hold fragile nighties and retain the shape of delicate knits as does the human body, a hanger which possesses a base bar for pants.

1 Claim, 1 Drawing Sheet

GARMENT HANGER

BACKGROUND OF THE INVENTION

1. Field of the Invention

The invention is an oversized hanger with egg-shaped shoulder areas, combined with a hanger bar that has an elevation and indentation with a smooth transition of shape at the dip or indentation, intended to support oversized, knitted, fragile, shoulder-padded, and off the shoulder clothing, that when being stored or displayed need the retention of their intended contour to achieve maximum appearance and longevity, especially when investment in such garments is costly.

2. Description of the Prior Art

No single, unitary hanger up until now has provided the size and contour to accommodate in a superior fashion all of the following: off the shoulder, as well as oversized, knitted, fragile nightwear and shoulder-padded garments.

It has been proposed in the past to provide the above mentioned modifications, wherein the purpose tried to accomplish adequate support to prevent these garments from slippage and wrinkling. However, although it was their intention, prior art did not, in fact, adequately simulate the human shoulder areas to meet the needs of all of the above mentioned garments.

SUMMARY OF THE INVENTION

The invention is an oversized hanger offering a combination of contours and dimensions for style and length, critical to support clothing of a larger, more fragile, off the shoulder and shoulder-padded type being marketed by today's contemporary designers. It is an object of the invention to give designer clothing especially of a more costly nature, superior support and to prevent such clothing from becoming mis-shapen and displaced from the hanger while being displayed for marketing or supported for storage in the home.

DESCRIPTION OF THE PREFERRED EMBODIMENT

Figure 1:
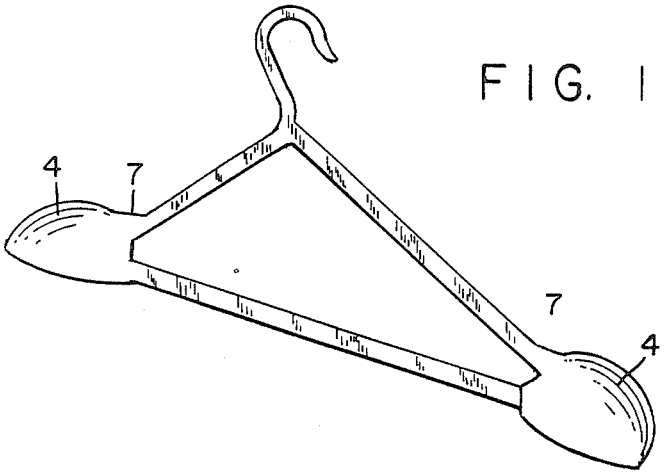
FIG. 1 illustrates a perspective view of the garment hanger of the invention.
Figure 2:
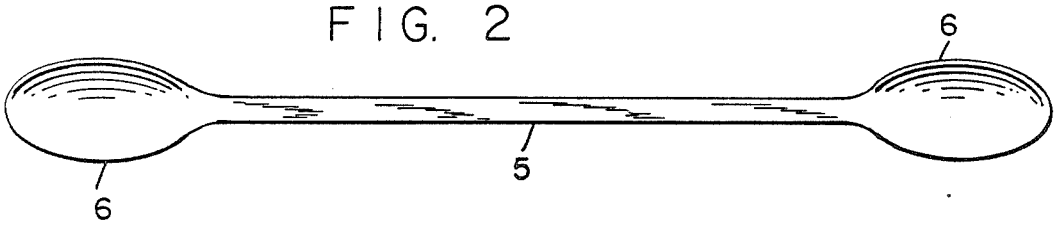
FIG. 2 is a plan view of the hanger of FIG. 1.
Figure 3:
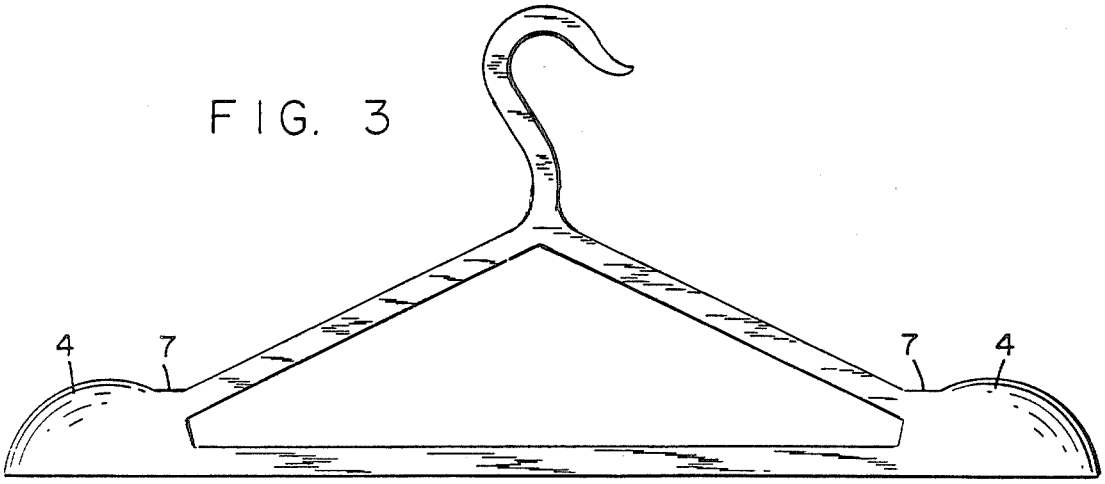
FIG. 3 is a front elevational view of the hanger of FIG. 1.

Reference numeral 4 of FIG. 1 indicates heightened elevation of an egg-shaped shoulder area, critical to protect fragile knits from becoming mis-shapen. Reference numeral 5 of FIG. 2 is length of approximate 19½" to give oversized, shoulder-padded, or fur garments a natural lift and is spread open to avoid the areas in the front from becoming mis-shapened with front folds. Reference numeral 6 of FIG. 2 is width of egg-shape of approximate 2¼". It is the combination of Reference numerals 4, 5, and 6 that are responsible for the support of undersides of the shoulder portions of the garment and effectively give the support necessary to purpose. Reference numeral 7 of FIG. 3 indicates the slight, smooth indentation between the end of the slant and the beginning of the heightened elevation (critical dip) of the oval surface of the egg-shaped areas, necessary to hold securely the spaghetti-strap and string dresses, teddie or delicate nightwear. Reference numeral 7 is also critical, combined with Reference numerals 4 and 6 to accurately simulate the human shoulders in effectively protecting and retaining the intended shape of the fragile knits, shoulder-padded and off-the-shoulder garments.

I claim:

1. An oversized unitary, one-piece garment hanger comprising a hook portion for suspending the hanger from a supporting member and a body portion for supporting oversized garments while retaining the contour thereof, said body portion comprising a pair of diagonally positioned side members extending from the hook portion with each of said side members merging into an inner end of an egg-shaped shoulder area, the shoulder area constituting opposed terminal ends of the hanger body, and a cross-bar connecting the inner ends of the egg-shaped shoulder areas and spaced from the diagonally positioned side members to define an opening therebetween, each said shoulder area constituting an elevated and widened extended area of egg-shaped contour on each end of the hanger body from adjacent the opening to the terminal end thereof, the extent of the hanger body between the terminal ends thereof being 9½ inches, a slight smooth indentation between the end of each side member and the beginning of the elevated extent of the corresponding egg-shaped area, the widened extent of which being approximately 2¼ inches, whereby oversized knitted, fragile and shoulder-padded articles of clothing may be supported thereon while retaining the intended contour thereof.

* * * * *